United States Patent [19]

Johnson et al.

[11] 4,069,144

[45] Jan. 17, 1978

[54] PHOSPHATE ORE RECOVERY

[75] Inventors: George C. Johnson, Princeton, N.J.; Albert E. Schweizer, Levittown, Pa.

[73] Assignee: Mobil Oil Corporation, New York, N.Y.

[21] Appl. No.: 633,535

[22] Filed: Nov. 19, 1975

[51] Int. Cl.[2] ..... B03B 1/02

[52] U.S. Cl. ..... 209/11; 209/166

[58] Field of Search ..... 209/11, 166, 167; 241/39

[56] References Cited

U.S. PATENT DOCUMENTS

| | | | |
|---|---|---|---|
| 1,901,221 | 3/1933 | Bullwinkel | 209/166 X |
| 2,162,494 | 6/1939 | Trotter | 209/166 |
| 2,336,868 | 12/1943 | Jayne | 209/166 |
| 2,811,254 | 6/1957 | McGarry | 209/166 |
| 2,903,131 | 9/1959 | Heinrichs | 209/166 X |
| 3,302,785 | 2/1967 | Greene | 209/166 X |
| 3,329,352 | 7/1967 | Clary | 241/39 |
| 3,456,360 | 7/1969 | Tenakawa | 209/11 X |
| 3,646,689 | 3/1972 | Kuchenthol | 209/11 X |
| 3,880,703 | 4/1977 | Maudman | 209/11 X |

*Primary Examiner*—Robert Halper

*Attorney, Agent, or Firm*—Charles A. Huggett; Claude E. Setliff

[57] ABSTRACT

The invention is an improvement in the process of benificiating phosphate ores, the process including at least one acid flotation and at least one amine flotation. The improvement is a reduction in the formation of slimes, obtained by drying the phosphate ore prior to classification and flotation or by transporting it to the flotation plant out of contact with water.

4 Claims, 1 Drawing Figure

SUBSIDENCE TEST ON PHOSPHATE ORE IN WATER

SUBSIDENCE TEST ON PHOSPHATE ORE IN WATER
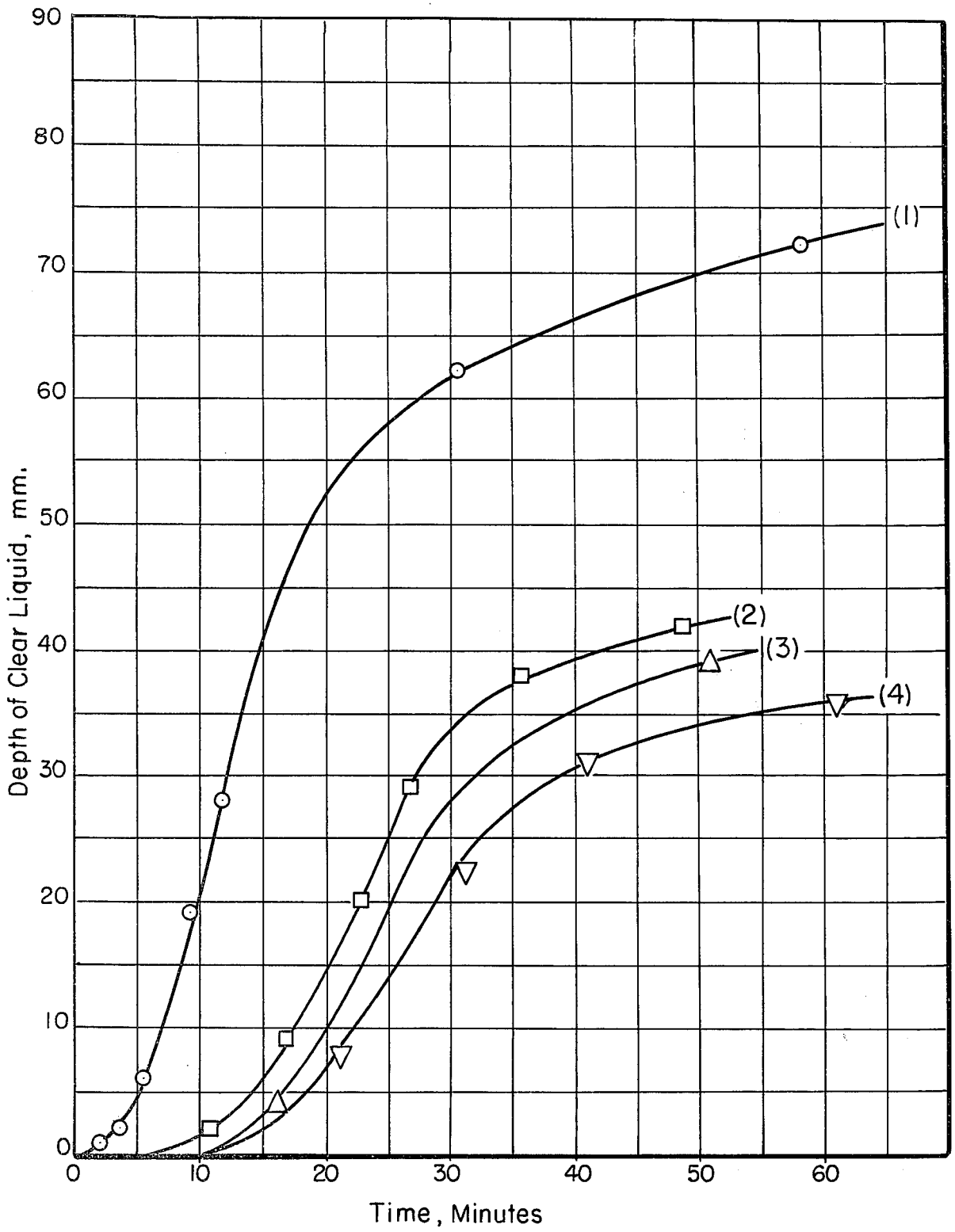

PHOSPHATE ORE RECOVERY

BACKGROUND OF THE INVENTION

1. Field of the Invention

The invention is concerned with the beneficiation of phosphate ore. More particularly, it is concerned with the reduction of the amount of slimes formed after mining but before beneficiation.

2. Discussion of the Prior Art

At present, phosphate rock obtained from strip mines, as in Florida, is slurried with large quantities of water and is pumped over long distances and under turbulent conditions to the beneficiation plants. Such treatment produces large amounts of slimes, resulting in potential losses of product of about 20%. Present practices for recovery of slimes include flocculation with various flocculants to dewater them. However, there is no method known or practiced which will prevent their formation.

SUMMARY OF THE INVENTION

The invention provides an improved process for beneficiation including at least two separate flotation steps. The first flotation step is one in which a reagent comprising a fatty acid or other commonly used material is used. The second flotation employs an amine or an amine salt. The improvement herein involves the use of a feed that has been dried or has been transported to the flotation plant in the dry state, i.e. its contact with water has been drastically or completely eliminated until flotation begins.

DESCRIPTION OF SPECIFIC EMBODIMENTS

Phosphate rock in Florida occurs in sedimentary deposits below an average of 15 feet of overburden. The top layer of overburden is mostly sand and averages about 9 feet in thickness. The remaining 6 feet is referred to as the "leach zone". This is a zone of aluminum phosphate minerals which averages the equivalent of 20 to 30% of aluminum phosphate. 5 to 15% is clay and the remainder sand. The next 15 feet is the matrix and is the actively-mined zone. The matrix is an unconsolidated mixture with a composition approximately 40% of a defect fluorapatite (the main phosphate component); 39% of quartz sand; 15% of a mixture of clays; and about 6% of wavellite and other minerals.

The present process for beneficiation phosphate ore, containing about 14% $P_2O_5$, to an average of about 32% $P_2O_5$ includes slurrying the matrix in water and pumping the slurry to the washer and beneficiation plant. During the slurrying, transporting and washing of the matrix a suspension of clay in water is formed. This suspension, or so called phosphate slime, actually begins to form early in the process when the slurry for the pipeline is prepared.

The phosphatic slimes waste constitute at least 20% of the total matrix mined. These slimes are primarily a suspension of clay particles in water and are so finely divided that effective settling does not take place. As has been said before, they begin forming early in the process, and result, apparently, from the deflocculating effect of the phosphate on the clays, mostly on the attapulgite. Of course, the longer the ore remains in contact with water, and the more vigorously the water is agitated, the more slime will form.

Since the solids content of phosphate slimes is between about 2 and about 5%, obviously, vast quantities of water are tied up and huge tracts of land are required to dispose of them at present. Present practice is to store such slimes in ponds surrounded by dams made from overburden. There are always the constant danger of dam breakage, and the potential for damage that would result therefrom. Aside from this is the sheer length of time before slime ponds become useful for anything more than grassy marsh. This is because the solids settle extremely slowly. For example, after 15 years, the slimes reach there ultimate solids level of 23 to 28%. Solids levels of at least 40% to 50% are needed to make pasture land for cattle grazing. Higher levels are needed for development land.

A great deal of work has been done to solve the phosphate slimes problem, the most success to date having been achieved with various flocculants. In some cases, these are supplemented by the addition of overburden and sand tailings. All this, however, represents a huge investment in money and time and a loss of real estate, precious water reserves and phosphate values.

The industry is thus highly motivated to find a better solution to the slimes problem. The ideal solution, of course, is to eliminate the formation of slimes. We have found that by drying the phosphate ore, or by simply avoiding prolonged contact with water and especially vigorous agitation therein, slimes can be very substantially reduced.

Clay minerals of the type present in the phosphate matrix will absorb water over several hours and swell, or increase in volume, and retain this water. These clays will do this reversibly if the dehydration is not so severe it alters the mineral itself. These clays have been dehydrated in the matrix by the overburden pressure, so they are unswollen, even though the phosphate matrix often occurs below the local water table. The matrix is often mined at the edge of the local water table, and simply placing the matrix above the local water table will drain some of the water away from it and partially dry it. This drying can be aided by covering, or air circulation, or sun exposure. Then the matrix can be transported to the beneficiation plant dry. Since the rehydration of these clays is not instantaneous, but takes several hours, rapid hydraulic or slurry processing at the washer plant results in a reduction in slime production.

It is evident from preceding disclosure that the primary object of the present invention, i.e. avoiding formation of slimes, can be attained by dry-transporting the ore to the beneficiation plant by any means desired. One advantageous means which avoids the use of water to transport, and which provides for substantial dewatering, is the conveyer belt. Phosphate rock as mined contains about 30% water. Over the distances the ore travels from the mine (up to 4–5 miles), the water loss will be about 10% to 20% unless, of course, the conveyor is left open to rain. Obviously, the amount of water lost is not critical with fresh ore, the primary concern being avoidance of vigorous and prolonged water contact prior to beneficiation.

As indicated above, slimes can be avoided by drying the ore prior to beneficiation. This can be done by any means common to the art, including, where economically practical, drying in storage. Samples stored over several months will lose a substantial proportion of the water present in the ore as mined, but again the amount is not critical. Also, drying may be accomplished by circulating warm air, by hot air in a fluidized bed and by other means.

In general terms, the process of this invention involves the following steps. After the phosphate rock is mined, it is conveyed to the beneficiating plant by means other than as a slurry in water. The ore may, as already mentioned, be stored prior to beneficiation or it may be dried by mechanical means. Once at the processing plant, the ore is mixed with water and is classified by rapidly putting it through a series of screens, washers, cyclones and sizers. The flotation feed is pumped into a feed conditioner where a fatty acid, or other organic compound or compounds, a petroleum fraction and caustic are blended in.

The fatty acid may be any acid normally used in phosphate ore beneficiation. Usually, this acid is an oleic acid ($C_{18}$) or a mixture of acids of the $C_{18}$ molecular weight range. One acid that is commonly used in the industry has the approximate composition:

| Acid | Percent |
|---|---|
| Palmitic | 6 |
| Palmitoleic | 2 |
| Stearic | 1 |
| Oleic | 31 |
| Linoleic | 42 |
| Docosenoic | 3 |
| Linolenic | 5 |
| Rosin | 7 |
| Unsaponifiables | 3 |

The acid flotation produces a so-called rougher concentrate, which is passed through an acid deoiler section where the concentration is treated with sulfuric acid to remove fatty acid. It is then washed, treated with an amine and a petroleum fraction and refloated to remove the silica that floated with the apatite in the first stage.

The petroleum fraction useful in phosphate flotation processes can be any of a number of products normally used in the phosphate industry. These include kerosene, or range oil, and the distillate fuel oils, including Nos. 1 through 6. Further, the term "petroleum fraction" includes those whose properties are described on pages 11–41 through 11–56 of the Petroleum Processing Handbook, McGraw-Hill Book Company (1967).

The useful amines include those described in U.S. Pat. No. 3,388,793. They also include fatty acid amines such as those described in U.S. Pat. Nos. 3,817,972 and 3,768,646.

Somewhat more specifically, we have found that one has to work hard to make a slime in the laboratory when using samples of ore taken directly from the phosphate ore body prior to water transporting. In a set of qualitative tests, we found that, when using a sample of phosphate matrix that had dried out to about 6 to 8% water, slimes could be avoided substantially by limiting the time of contact and severity of agitation in water.

According to this test:

1. 0.94 g of the ore just mentioned was mixed with 14 cc tap water and shaken vigorously 100 times by hand in a test tube (depth of materials 103mm). A layer of grit formed almost at once, and after a short time, a floc formed and began to settle;

2. After 17 hours, the tube was shaken again; and (3) and (4) Subsequently two further trials were made.

The above was done to measure the rate of subsidence or downward movement of the boundary between the clear liquid and the solid.

The FIGURE is a graph showing the depth of clear liquid in millimeters as a function of time in minutes. In the FIGURE the various curves are plots of the individual tests above, the individual curve number corresponding to the test number.

In an effort to obtain an even more rapid subsidence than in (1) of the FIGURE, the experiment was repeated, except that the mixture was shaken only enough to get all of the solid suspended. In 10 minutes, 62 mm of clear zone had appeared, compared to 20 mm in (1) for the same length of time. Furthermore, there is a clear indication that prolonged contact with water is detrimental. For example, in a test run under the conditions of test (1) above, the depth of clear zone, 1,032 minutes after shaking, was 82 mm. Also, in a test run as in test (4), the depth of clear zone, 1,480 minutes after final shaking, was only 54 mm. These results are self-explanatory.

EXAMPLE

A sample is removed from the phosphate rock as mined and transported out of contact with water to the beneficiation plant, is classified and is then mixed with a fatty acid (as disclosed hereinabove), a petroluem fraction and sodium hydroxide. This is then run through the fatty acid flotation cells to obtain the rougher concentrate. The rougher concentrate is deoiled with sulfuric acid, washed, and treated with aeromine 3037, mentioned in U.S. Pat. No. 3,388,793, and kerosene. This is then run through an amine float to remove the silica collected with the rougher concentrate. By following the procedure given, the quantity of slimes produced is substantially reduced.

We claim:

1. An improved process for beneficiating phosphate rock, which process includes at least an acid flotation step and an amine flotation step in which the usual reagents are used, the improvement whereby the mined phosphate rock is dried by a process selected from those consisting of transport, storage or air circulation immediately prior to classification and is mixed with water and classified prior to flotation.

2. The process of claim 1 wherein the drying is accomplished by circulating warm air.

3. The process of claim 1 wherein said rock is dried during transport.

4. The process of claim 1 wherein said rock is dried during storage.

* * * * *